US006117002A

United States Patent [19]

Stokes et al.

[11] Patent Number: 6,117,002

[45] Date of Patent: Sep. 12, 2000

[54] BLADE SHARPENER

[75] Inventors: Andrew John Stokes, Sheffield; George Ralph Adkins, Rotherham, both of United Kingdom

[73] Assignee: McPherson's Limited, Australia

[21] Appl. No.: 09/454,329

[22] Filed: Dec. 3, 1999

[30] Foreign Application Priority Data

Dec. 4, 1998 [AU] Australia ..... PP7491

[51] Int. Cl.[7] ..... B23F 21/03; B23F 21/22

[52] U.S. Cl. ..... 451/555; 76/82; 76/86; 30/138

[58] Field of Search ..... 76/81, 81.4, 82, 76/86, 88; 7/120; 451/321, 322, 555, 556, 523, 524; 30/138, 298.4; 431/231, 232, 234, 371, 163, 349

[56] References Cited

U.S. PATENT DOCUMENTS

| | | | |
|---|---|---|---|
| 3,676,961 | 7/1972 | Jackson | 451/555 |
| 3,774,350 | 11/1973 | Bayly | 451/255 |
| 3,861,246 | 1/1975 | Waller | 76/82 |
| 3,889,809 | 6/1975 | McNair | 206/372 |
| 4,041,651 | 8/1977 | Bayly | 451/255 |
| 4,091,691 | 5/1978 | Bayly | 76/86 |
| 4,494,339 | 1/1985 | Pittaway | 76/82 |
| 4,805,350 | 2/1989 | Farrer | 451/555 |
| 5,009,040 | 4/1991 | Petroff | 451/555 |
| 5,784,786 | 7/1998 | Williams | 30/138 |

FOREIGN PATENT DOCUMENTS

| | | | |
|---|---|---|---|
| 2618275 | 12/1984 | United Kingdom | 76/81 |

*Primary Examiner*—Derris H. Banks

*Attorney, Agent, or Firm*—Trexler, Bushnell, Giangiorgi & Blackstone, Ltd.

[57] ABSTRACT

A blade sharpener having a sharpening mechanism that functions to sharpen a blade engaging the mechanism and being moved longitudinally relative to that mechanism. The sharpening mechanism is located within a hollow housing or scabbard for containing the blade, and means is provided to restrain the blade against inadvertent removal from the housing. The blade is moved into and out of the housing through a front end of the housing, and the restraining means becomes operative (automatically) when the blade is fully inserted. Locking means then functions to prevent release of the restraining means, and that locking means includes a plate movable in the longitudinal direction of the housing between locking and unlocking positions. The locking means is moved into the unlocking position by actuation of a press button located at the rear end of the housing, and automatically returns to the locking position when pressure is removed from the press button.

30 Claims, 5 Drawing Sheets

BLADE SHARPENER

FIELD OF THE INVENTION

This invention relates to blade sharpeners, and is particularly but not exclusively concerned with knife and scissor blade scabbards which incorporate a blade sharpener. It will be convenient to hereinafter describe the invention with particular reference to knife blade scabbards of the kind incorporating a mechanism for sharpening the blade cutting edge.

PRIOR ART

Examples of combined scabbard-sharpeners are disclosed by U.S. Pat. Nos. 3,676,961, 3,774,350, 4,041,651, 4,091, 691, 4,805,350, 5,009,040 and 5,784,786, and GB 2168275.

It is generally the case that scabbard-sharpeners of the foregoing kind do not include means for resisting withdrawal or dislodgment of a contained knife blade. That leads to the possibility of a child withdrawing the knife blade, and the further possibility of the blade being dislodged from the scabbard by accident or inadvertence. In any of those situations a person could sustain injury from the sharp cutting edge of the exposed blade.

U.S. Pat. No. 5,784,786 discloses a scabbard-sharpener having blade restraining means which requires deliberate release in order to enable a blade to be removed from the scabbard. That arrangement is a substantial improvement over the prior art and had been successful in practice, but it does have some disadvantages. The restraining means is relatively complicated and consequently adds to the cost of manufacturing the product. Also, the mechanism whereby the restraining means is released is operated by a squeeze action and is therefore inconvenient to operate.

GB Patent 2168275 also discloses a scabbard-sharpener combination having means resisting inadvertent removal of a knife blade from the scabbard. That particular scabbard-sharpener does not appear to have been developed to a marketable stage, and that may be due to the relative complexity of the product construction. The blade restraining means and the release mechanism for that restrainer are both of relatively complicated construction. Also, operation of the release mechanism would be difficult, and possibly dangerous, because of the top location of the release button and the closeness of that button to the front of the scabbard through which the knife blade is moved.

SUMMARY OF THE INVENTION

It is an object of the present invention to provide a blade sharpener with relatively simple blade restraining means. It is a further object of the invention to provide such a restraining means which is convenient to release. It is still another object of the invention to provide such a blade sharpener that is relatively safe to use.

A blade sharpener according to the invention includes sharpening mechanism mounted on a support for relative movement between an operative position and an inoperative position at which it can and cannot respectively sharpen a blade cutting edge. The mechanism is responsive to longitudinal movement of a blade engaging that mechanism so as to adopt a respective one of the two positions according to whether the blade longitudinal movement is in an outward direction or an inward direction. Blade restraining means is operative to prevent longitudinal movement of the blade in the outward direction from a rest position at which substantially the entire cutting edge of the blade is located at an inner side of the sharpening mechanism. Locking means is movable relative to the restraining means in the longitudinal direction of the blade between a locking position at which the restraining means is maintained operative, and an unlocking position at which the restraining means is rendered inoperative to prevent the blade moving in said outward direction, and release means is operable to cause the locking means to move from the locking position to the unlocking position.

In a preferred arrangement the release means is operable by means of a release button which can be operated by a single finger. It is also preferred that the locking means includes a member which is slidable between active and inactive positions and is urged into the active position by a spring or other biasing means.

The restraining means preferably includes a member that is pivotably mounted for movement between the operative and inoperative positions, and is engageable with the choil of a blade, or is located within a recess of the blade, when in the operative position. That member may form part of or be associated with the blade sharpening mechanism.

It is further preferred that the blade sharpener includes a hollow housing and a sub-assembly removably mounted in the housing. Any suitable means may be used to releasably attach the sub-assembly to the housing. The subassembly may include the sharpening mechanism, a blade guide, and latch means arranged to engage the back edge of a blade and press the blade into engagement with the sharpening mechanism.

DESCRIPTION OF THE DRAWINGS

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION OF PREFERRED EMBODIMENTS

Figure 2:
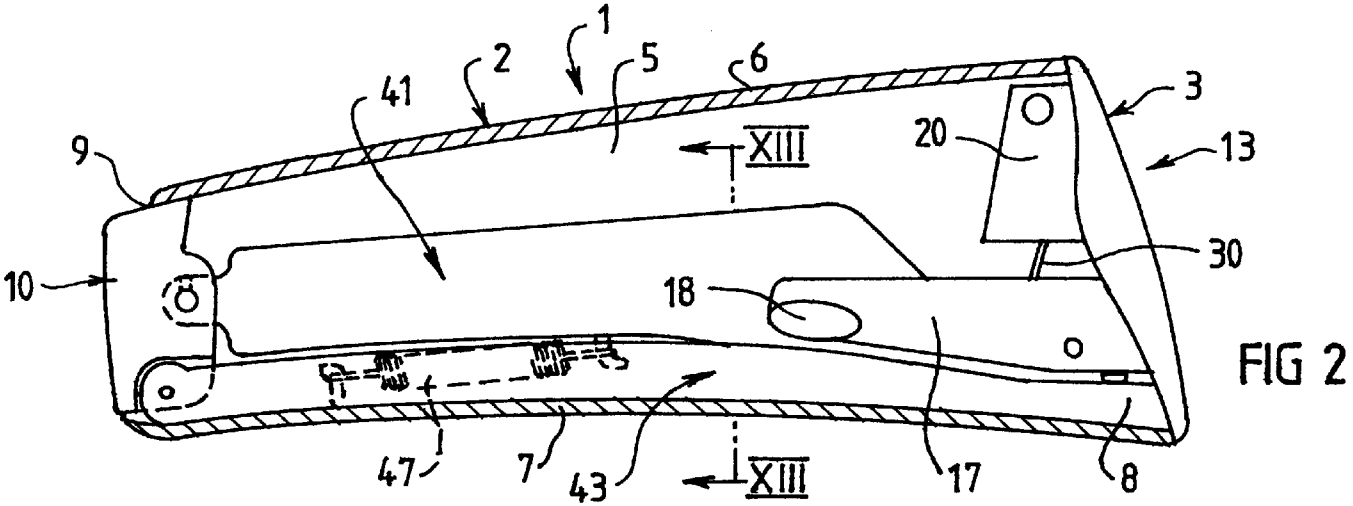
FIG. 2 is a longitudinal cross-sectional view of the housing or scabbard shown by FIG 1.
Figure 1:
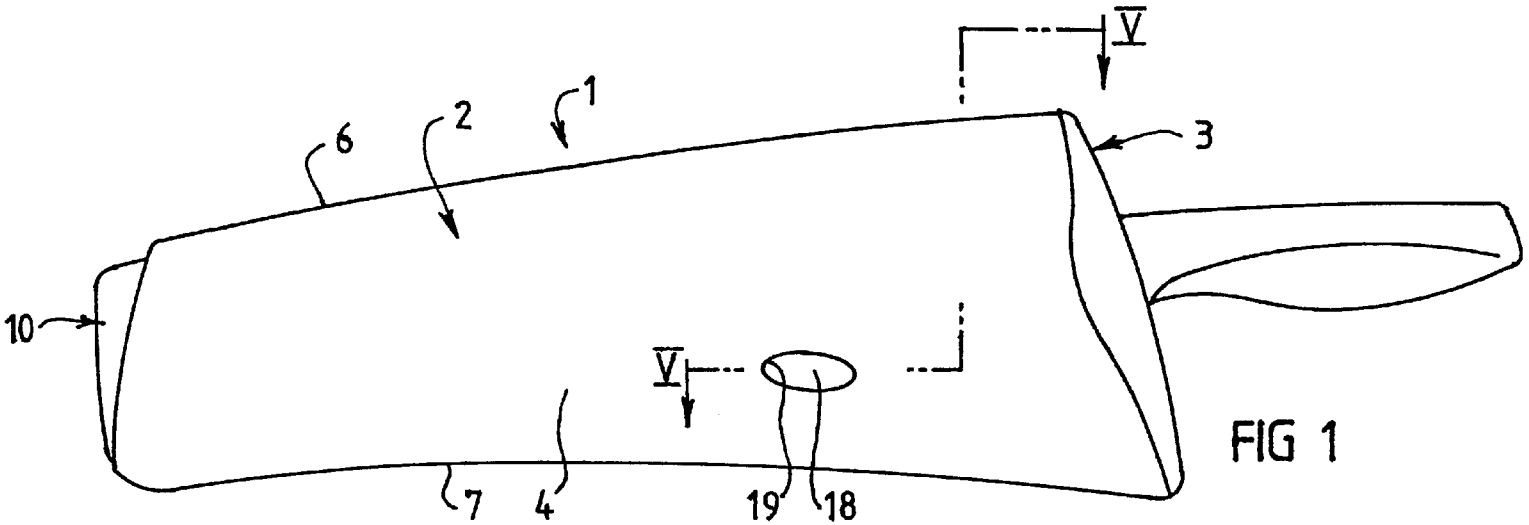
FIG. 1 is a side elevation view of an example embodiment of the invention in which knife is shown inserted into the housing or scabbard.

In the particular embodiment shown in the drawings, the blade sharpener includes a housing 1 composed of a main body 2 that is of generally tubular form having side walls 4 and 5, a top wall 6, and a bottom wall 7 (FIGS. 1 and 2). An opening is formed through each end of the main body 2. A front end opening 8 is closed by an end cap 3, and a rear end opening 9 is closed by a release button 10 which functions as hereinafter described. It is preferred that the body 2 is moulded or otherwise formed as a single piece from a plastics material.

Figure 4:
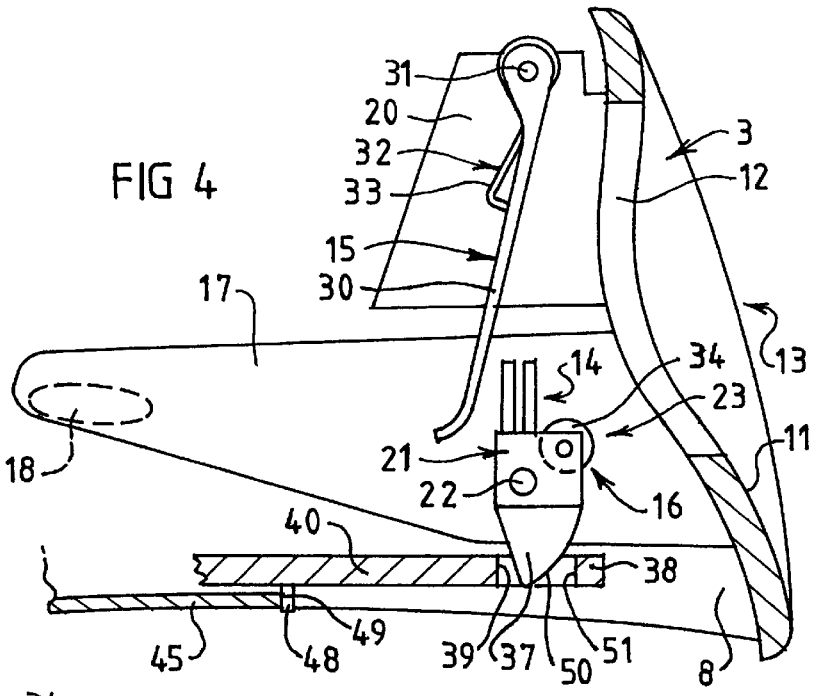
FIG. 4 is an enlarged cross-sectional view taken along line IV—IV of FIG. 3.
Figure 3:
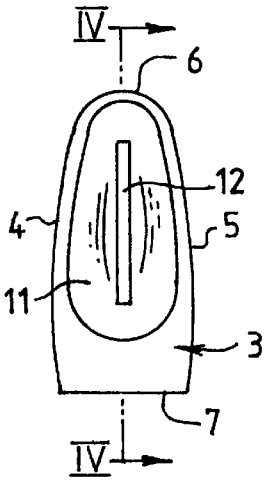
FIG. 3 is a front-end view of the housing shown by FIG. 2.

As best seen in FIGS. 3 and 4, the end cap 3 includes a wall 11 that extends across the opening 8 and has a slot 12 formed therethrough to provide an access opening for a blade to be moved into and out of the main body 2 of the housing 1. The slot 12 is shaped and dimensioned to suit the cross-sectional shape and dimensions of a blade to be moved within the housing 1. In particular, the slot 12 preferably forms part of guide means for keeping the blade in a particular path of travel during movement into and out of the main body 2, and for also inhibiting lateral tilting of the blade during such movement.

It is preferred that the end cap 3 forms part of a sub-assembly 13 which is releasably attached to the main body 2. In the arrangement shown (FIG. 4), the sub-assembly 13 includes blade sharpening mechanism 14 and latch means 15 which functions to press a blade into engagement with the sharpening mechanism 14 as hereinafter described. The sub-assembly 13 as shown also includes the blade restraining means 16 and a blade guide 41 (FIG. 2).

Figure 5:
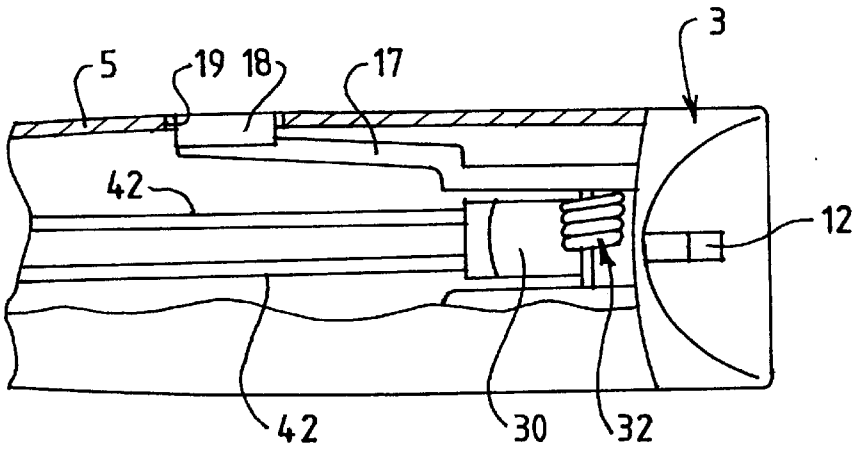
FIG. 5 is an enlarged cross-sectional view taken along line V—V of FIG. 1.
Figure 7:
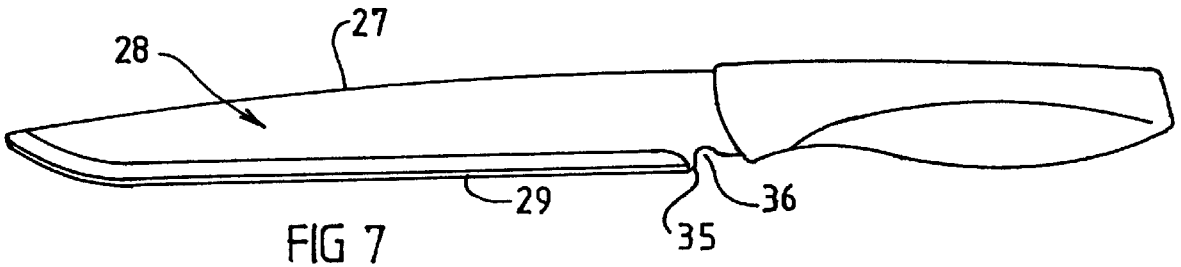
FIG. 7 is a side elevation view of one form of knife particularly suited or use with the blade sharpener of FIGS. 1 to 6.

Any suitable means could be adopted to releasably attach the sub-assembly 13 to the main body 2. In the arrangement shown that means include two locking arms 17 (FIGS. 2, 4 and 5) extending rearwardly from the end cap wall 11, and each of which has a detent 18 arranged to locate within a cooperable aperture 19 formed through a respective one of the side walls 4 and 5 of the main body 2. As shown in FIGS. 2 and 4, each detent 18 is preferably located at the end of the respective arm 17 which is remote from the wall 11. Each arm 17 is constructed so as to have a degree of flexibility to permit the arm 17 to move in a plane containing both of the apertures 19. The arrangement is such that each arm 17 has a natural bias such as to normally retain its detent 18 within the respective aperture 19, but the detent 18 can be moved inwards out of the aperture 19 by finger pressure. The sub-assembly 13 can be pulled free of the main body 2 through the front end thereof when both detents 18 are pushed inwards clear of their respective apertures 19.

The sharpening mechanism 14 may be attached to the sub-assembly 13 in any appropriate manner. In the arrangement shown by the drawings, that attachment is achieved by mounting the mechanism 14 between the arms 17, but other arrangements could be adopted. The latch means 15 is preferably mounted between two laterally spaced plates 20 located above the arms 17 and each of which is connected to and extends rearwardly from the wall 11.

Figure 6:
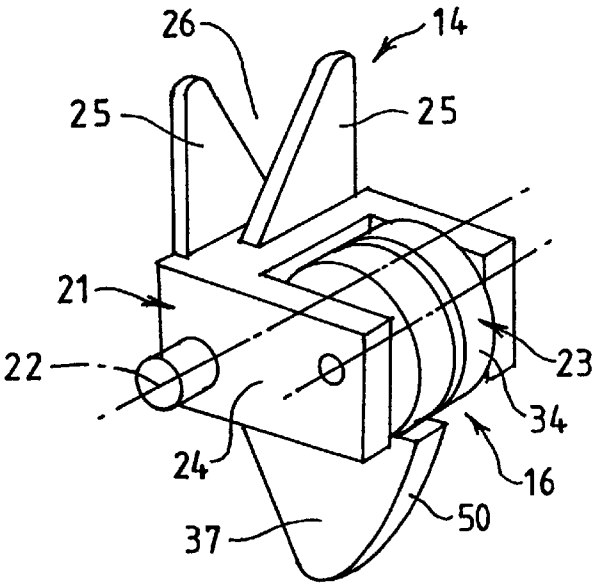
FIG. 6 is an enlarged perspective view of the sharpening mechanism included in the preferred embodiment represented by FIGS. 1 to 5.

Any suitable sharpening mechanism 14 could be adopted, but in the arrangement shown the mechanism 14 is generally in accordance with the disclosure of U.S. Pat. No. 5,009,040. That particular mechanism 14, which is best seen in FIG. 6, includes a sharpening device 21 pivotably mounted for back and forth movement about an axis 22, and also includes means 23 connected to the device 21 which functions to prevent or substantially reduce sharpening of a blade cutting edge during movement of the blade into the housing 1. The manner of operation of the sharpening defeating means 23 is fully described in the specification of U.S. Pat. No. 5,009,040. In the arrangement shown, the sharpening device 21 includes a carrier block 24 and two overlapping sharpening plates 25 attached to the block 24. A V-shaped sharpening recess 26 is defined between oppositely facing edges of the two plates 25 (FIG. 6).

Figure 9:
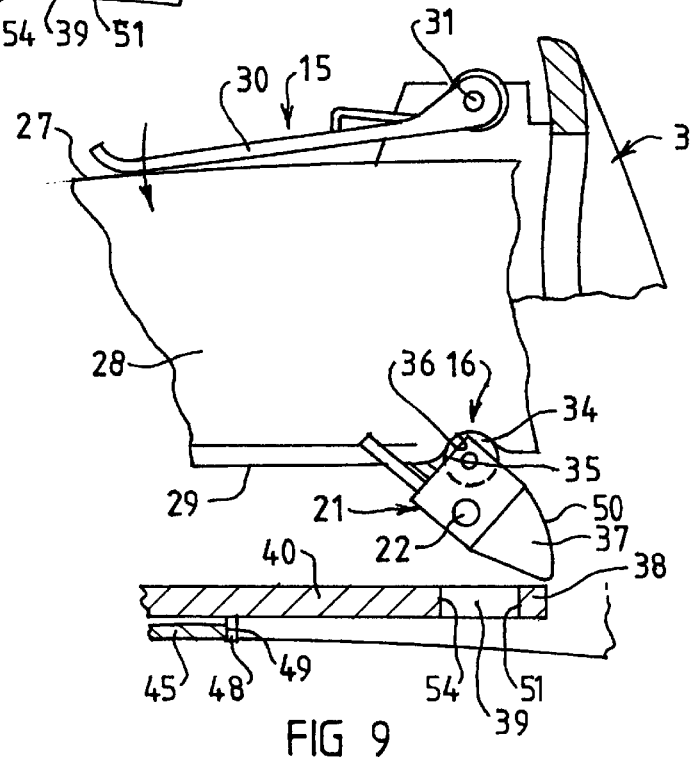
FIG. 9 is a view similar to FIG. 8, but showing the knife blade fully inserted into the hug.
Figure 8:
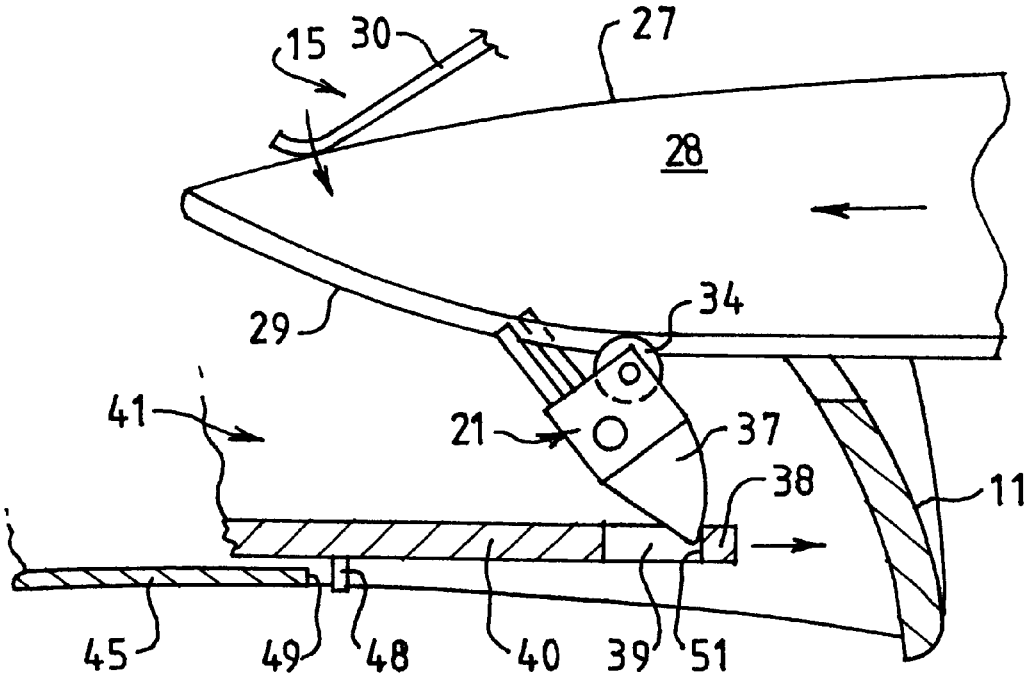
FIG. 8 is a view similar to FIG. 4, but showing a knife blade being inserted into the housing through the front end thereof.

As shown by FIGS. 8 and 9, the latch means 15 is arranged to apply pressure to the back edge 27 of a blade 28 located within the housing 1 so as to thereby urge the blade cutting edge 29 towards or into engagement with the sharpening device 21. In the particular arrangement shown (FIG. 4), the latch means 15 includes a lever or flap 30 located rearwardly of the wall 11 and directly in line with the blade access slot 12. The lever or flap 30 is arranged for pivotal movement about an axis 31 located well above and arranged generally parallel to the pivot axis 22 of the sharpening device 21. Biasing means 32 acts on the lever or flap 30 so as to resiliently urge the lever or flap 30 towards the wall 11 such that it effectively stands in the way of a blade 28 being moved into the scabbard through the access slot 12. In the particular arrangement shown, the biasing means 32 includes a torsion spring having one arm 33 bearing against the lever or flap 30 and another arm (not shown) bearing against a surface of the sub-assembly 13.

The blade sharpener includes blade restraining means 16 that functions to at least make it difficult for a blade to be withdrawn from the main body 2. In the particular arrangement shown and hereinafter described, that restraining means 16 acts on the blade 28, but in other arrangements it may act on the blade handle or some other member attached to the blade 28. Furthermore, part of the restraining means hereinafter described is movable about a pivot axis so as to adopt either an operative position or an inoperative position, but other arrangements are possible. It is also a feature of the particular arrangement shown that the restraining means is associated with the sharpening mechanism 14 so as to be rendered operative or inoperative according to whether the mechanism 14 is inactive or active respectively. It will be appreciated that such an arrangement is not essential and that the restraining means could be provided separate from the sharpening mechanism 14.

Figure 10:
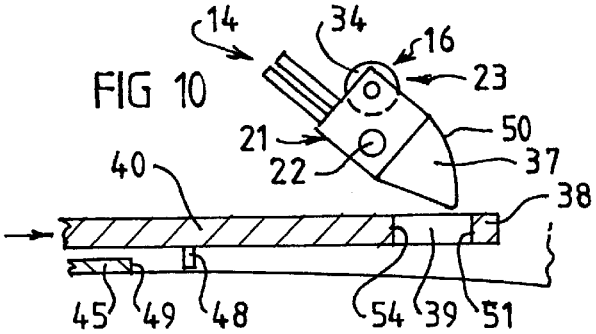
FIG. 10 is a view similar to FIG. 9, but showing the release means of the blade sharpener operated to allow the blade restraining means to swing into an inoperative position and thereby enable removal of the knife blade from the housing.
Figure 11:
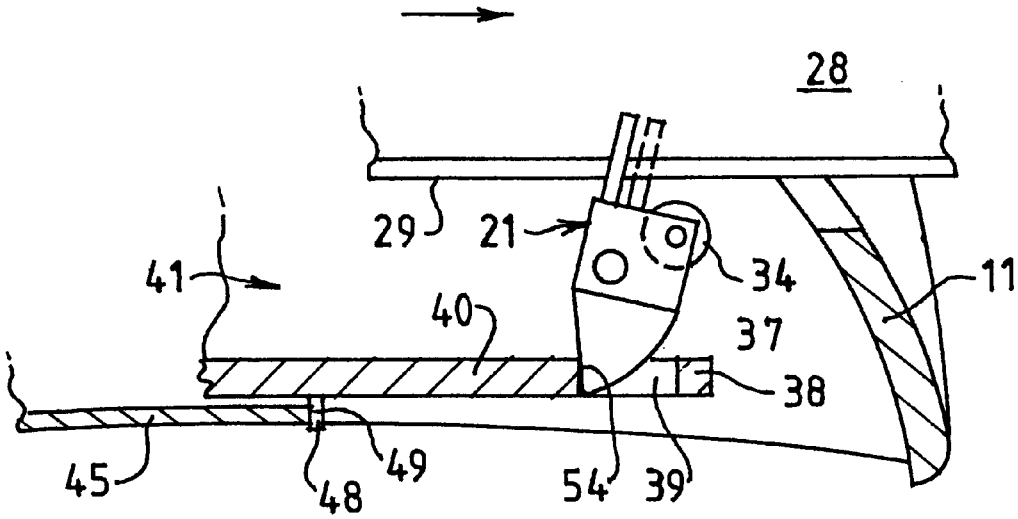
FIG. 11 is a view similar to FIG. 9, but showing the blade restraining means in the inoperative position and the blade being moved out of the housing through the front end thereof.

As will be apparent from FIGS. 11 and 10, the sharpening device 21 pivots between forward and rearward positions at which it does and does not respectively function to effectively sharpen a blade 28. That pivotal movement of the sharpening device 21 is utilised as the means for changing the mode of the restraining means between operative and inoperative. It will be appreciated that a pivoted device other than one forming part of the mechanism 14 could be suitable for that purpose.

When the sharpening device 21 is in the rearward pivoted position as shown by FIGS. 9 and 10, the associated restraining means 16 is conditioned to be operative, but as hereinafter explained other requirements need to be satisfied in order for the restraining means to become operative. Any suitable release means may be provided to permit the restraining means 16 to be disabled or rendered inoperative such that a blade 28 can be withdrawn from the housing 1.

In the particular arrangement shown, the restraining means 16 includes or is formed by part of the sharpening defeating means 23. As previously explained, the construction and function of the sharpening defeating means 23 is fully described in the specification of U.S. Pat. No. 5,009,040.

The restraining means 16 of the particular embodiment shown includes a roller 34 which also forms part of the sharpening defeating means 23. When the sharpening device 21 is in the rearmost position as shown by FIG. 9, the roller 34 locates in front of the choil 35 of the knife blade 28 so as to thereby provide an obstruction to withdrawal of the blade 28 from the housing 1. It is preferred that a recess 36 is formed in the blade edge adjacent the choil 35 so as to permit the roller 34 to be located at a sufficiently high position relative to the blade cutting edge 29.

Locking means functions to prevent the sharpening device 21 being moved from the FIG. 9 position towards the FIG. 11 positions at which the restraining means 16 is inoperative. In the arrangement shown, that locking means includes a projection 37 extending downwardly from the underside of the sharpening device 21, and a stop plate 38 which is engaged by the projection 37 if an attempt is made to pivot the device 21 from the FIG. 9 position towards the FIG. 11 position.

Release means is operable to move the plate 38 forwardly to a position at which it is no longer engageable by the projection 37. Forward pivotal movement of the sharpening device 21 is then possible because the projection is able to move into an opening 39 located behind the plate 38.

Figure 12:
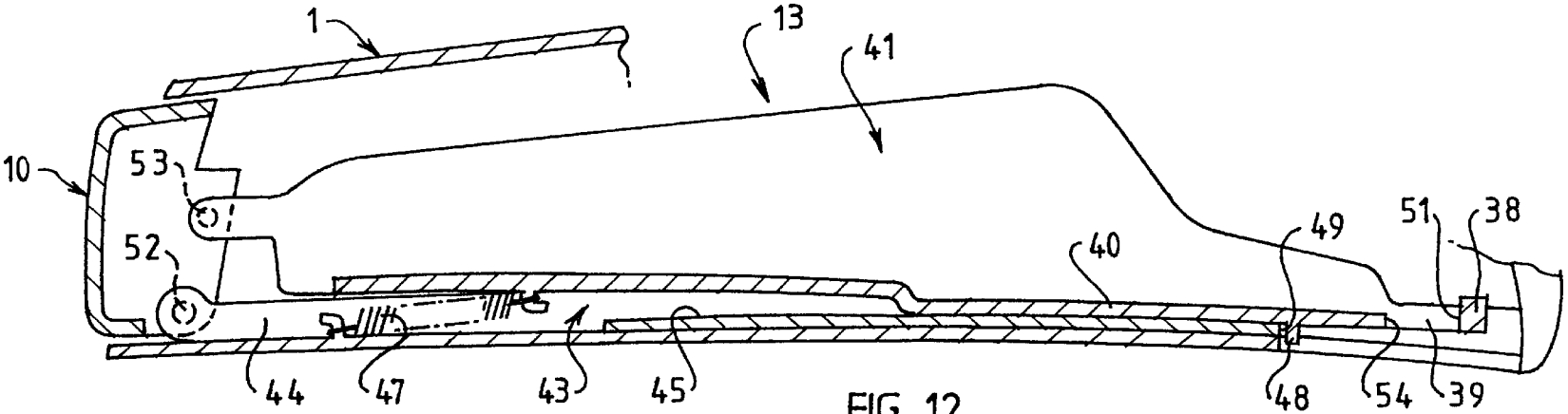
FIG. 12 is an enlarged longitudinal cross-sectional view of the embodiment of FIG. 1 to 6 in which parts have been omitted from convenience of illustration.
Figure 13:
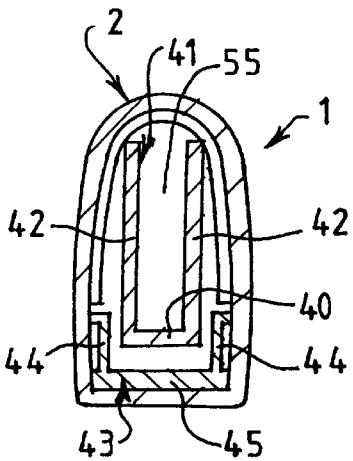
FIG. 13 is an enlarged cross-sectional view taken along line XIII—XIII of FIG. 2.

In the particular construction shown, the plate 38 forms part of a slidable member 40 which also includes the opening 39. The member 40 may advantageously form the base of the blade guide 41 located within the hollow interior of the main body 2 and which forms part of the sub-assembly 13. As best seen in FIGS. 12 and 13, the guide 41 includes two laterally spaced side walls 42 connected at their lower edges through the member 40. The plate 38 is formed on or by a forward extension of the member 40. The lateral spacing between the walls 42 is preferably selected to provide an effective guide groove 55 (FIG. 13) for a blade 28 received between them. It is also preferred that the walls 42 serve to prevent excessive lateral tilting of the blade 28.

The blade guide 41 is preferably connected to a support structure 43 attached to and extending rearwardly from the end cap wall 11. The support structure 43 could be formed separate from the end cap 3, but it is preferred that it is integral with the end cap 3 so as to be part of the sub-assembly 13. In the particular arrangement shown, the support structure 43 includes two laterally spaced arms 44 and a base plate 45 which interconnects the arms 41 over part of their length as best seen in FIG. 12. As also seen in FIG. 12, part of the member 40 rests on and is slidable over the base plate 45.

The release button 10, which forms part of the release means, is connected to both the support structure 43 and the blade guide 41 in a manner such that forward movement of the release button 10 relative to the structure 43 causes the guide 41, and consequently the member 40, to move relative to the structure 43. The arrangement is such that part of the release button 10 projects rearwardly from the housing 1 and is accessible for hand or finger engagement. A tension spring 47, or other biasing means, preferably acts between the structure 43 and the guide 41 so as to normally hold the guide 41 in a rearward position, which is the position shown by FIGS. 1, 2, 11 and 12. Stop means may be provided to prevent rearward movement of the guide 41 beyond that rearward position, and in the arrangement shown that stop means includes an abutment 48 connected to and projecting downwardly from the member 40. The abutment 48 is engageable with a front end 49 of the base plate 45 as shown in FIGS. 4, 9, 11 and 12.

Figure 15:
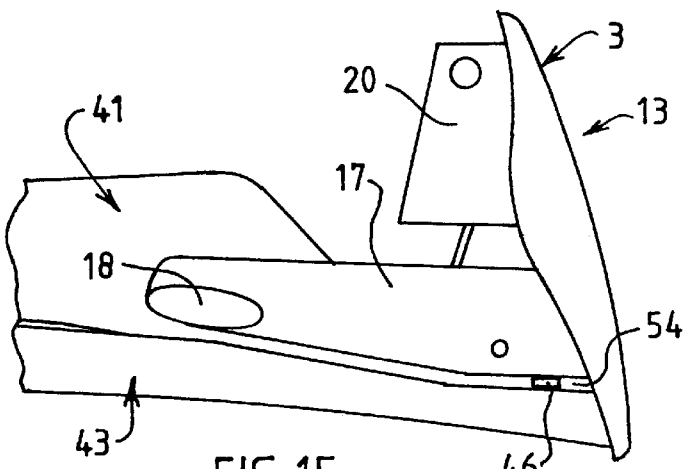
FIG. 15 is a side elevation view of the front end portion of the removable sub-assembly of the blade sharpener, showing the manner of cooperation between the blade guide and the support structure.

It is preferred to provide means whereby the front end of the blade guide 41 is held against substantial upward movement away from the structure 43. In the particular arrangement shown by FIG. 15, a laterally extending lug 46 is provided at each side of the guide 41 and slidably locates in a space 54 formed between opposed surfaces of the structure 43 and the adjacent arm 17. The space 54 provides a track within which the lug 46 slides when the guide 41 is moving forwards or backwards, and upward movement at the front end of the guide 41 is prevented by engagement between the lug 46 and the overlying arm 17.

The blade sharpener as particularly described and shown in the accompanying drawings operates in the following manner.

When the housing 1 is ready to receive a knife blade 28, the sharpening device 21 will usually be at the forward position as shown by FIG. 11. In order to insert the blade 28 into the scabbard, it is projected through the access slot 12 so as to press against the lever or flap 30. The lever or flap 30 is thereby forced to swing about the pivot 31 in a direction away from the front wall 11 so that the lower end of the lever or flap 30 engages and slides along the back edge 27 of the knife blade 28 (FIG. 8). As the blade 28 enters into the housing 1, the cutting edge 29 locates within the sharpening recess 26 and engages the plates 25 under the influence of the spring biased lever or flap 30.

Engagement between the blade 28 and the plates 25 causes the sharpening device 21 to pivot rearwardly as the blade 28 is moved rearwardly (FIG. 8), and as a consequence the roller 34 rises and engages the cutting edge 29 of the blade 28. The roller 34 functions to facilitate movement of the blade 28 into the scabbard because of its ability to rotate in the direction of blade movement, and also because it serves to lift the blade edge 29 off the sharpening plates 25, or at least reduces the pressure between the edge 29 and the plates 25. That function of the roller 34 is more fully described in the specification of U.S. Pat. No. 5,009,040.

Continued movement of the blade 28 into the scabbard causes the sharpening device 21 to swing rearwardly about the pivot 22 so as to move towards the position shown by FIGS. 9 and 10. In the course of that movement, a curved front edge 50 of the projection 37 engages a rearward side 51 of the plate 38 so that the plate 38 is pushed forwards relative to the end cap 3 (FIG. 8). That forward movement is permitted by extension of the spring 47. A position is thereby reached at which the projection 37 is located above the upper side of the plate 38, and the member 40 is then free to be pulled back to the rearward position by the spring 47 (FIG. 9). As a result, the projection 37 is positioned over the plate 38 as shown by FIG. 9, and it is no longer possible to return the sharpening device 21 to the position shown by either FIG. 4 or FIG. 11.

Figure 14:
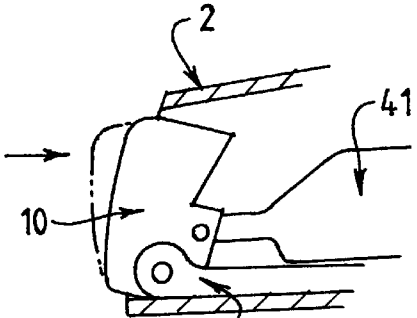
FIG. 14 is a cross-sectional view showing how the press button of the preferred embodiment is operated to release the blade restraining means.

Return movement of the sharpening device 21 to the FIG. 4 or FIG. 11 position is made possible by moving the release button 10 forward about the pivot connection 52 with the structure 43 (FIG. 14). Such forward movement causes the guide 41, and consequently the member 40, to move forward to the position shown by FIG. 10 at which the projection 37 is able to move into the opening 39 and thereby return to the position shown by FIG. 4, or FIG. 11. It is preferred, as shown, that the release button 10 is connected to the guide 41 through a pivotal connection 53 located some distance above the pivot connection 52. The spring 47 automatically returns the plate 38 to the position shown by FIGS. 4, 9 and 11 when finger pressure is removed from the release button 10. It is therefore necessary to commence withdrawal of the blade 28 from the scabbard while finger pressure is maintained on the release button 10, so as to thereby allow time for the projection 37 to move into the opening 39.

Because of contact between the blade 28 and the sharpener plates 25, outward movement of the blade 28 causes the sharpening device 21 to swing forwards about the pivot axis 22. The roller 34 is thereby lowered away from the cutting edge 29 and the projection 37 moves into the opening 39. Downward movement of the roller 34 renders the blade restraining means inoperative, and that means cannot return to the operative position if finger pressure is removed from the button 10 after the projection 37 enters the opening 39.

Continued outward movement of the blade 28 results in the cutting edge 29 being sharpened because the roller 34 no longer presses upwards against the blade 28, and the sharpening device 21 adopts and is retained in a position at which sharpening occurs. That sharpening position is achieved when the projection 37 engages against the edge 54 of the member 40 (FIG. 11), and further forward pivotal movement of the device 21 is prevented by that engagement. In that regard, the member 40 cannot move rearwards under the pressure applied by the projection 37 because of engagement between the abutment 48 and the edge 49. The sharpening device 21 is retained in the aforementioned sharpening position by the downward pressure exerted on the blade 28 by the spring influenced lever or flap 30.

It is preferred that the detents 18 function as the sole means retaining the sub-assembly 13 within the main body 2. That is, the sub-assembly 13 can be moved out of the main body 2 through the front end thereof when the detents 18 are pressed inwards to be freed from their respective apertures 19. It is further preferred that the various components of the sub-assembly 13 are held together without the aid of separately formed fasteners such as screws. The separately formed components of the sub-assembly 13 may clip together or snap engage in a manner which permits convenient assembly of those components. By way of example, each of the two pivot connections 52 and 53 may be achieved by resiliently distorting at least one of the components to permit pivot pins of one component to be located within cooperative bores of another component.

A scabbard-sharpener combination as described is safe and convenient to use, and is of relatively simple construction. The blade restraining means is effective in operation and can be easily and conveniently released by applying finger pressure to the release button. It is also significant that the release button is located remote from the front end of the scabbard through which the blade is removed, as that minimises the possibility of inadvertent contact between the blade cutting edge and the hand of the operator which is used to release the blade restraining means.

Various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A blade sharpener including, a sharpening mechanism mounted on a support for relative movement between an operative position and an inoperative position at which said sharpening mechanism can and cannot respectively sharpen a blade cutting edge, said mechanism being responsive to a longitudinal movement of a blade engaging that mechanism so as to adopt a respective one of said positions according to whether said longitudinal movement is in an outward direction or an inward direction, blade restraining means operative to prevent longitudinal movement of the blade in said outward direction from a rest position at which substantially the entire said cutting edge is located at an inner side of said mechanism, locking means movable relative to said restraining means in the direction of a longitudinal axis of said blade between a locking position at which said restraining means is maintained operative and an unlocking position at which said restraining means is rendered inoperative to prevent said blade moving in said outward direction, and release means operable to cause said locking means to move from said locking position to said unlocking position.

2. A blade sharpener according to claim 1, including a hollow housing for containing said blade, said mechanism is located within said housing adjacent a front end thereof, and an actuator for operating said release means is located at or adjacent a rear end of said housing.

3. A blade sharpener according to claim 1, wherein said sharpening mechanism adopts said operative position in response to longitudinal movement of said blade in said outward direction.

4. A blade sharpener according to claim 1, wherein said blade restraining means is movable between an active position at which the restraining means is operative, and an inactive position at which the restraining means is inoperative.

5. A blade sharpener according to claim 4, wherein said restraining means is connected to and is movable with said sharpening mechanism, and adopts said active position and said inactive position when the sharpening mechanism is in the inoperative position and the operative position respectively.

6. A blade sharpener according to claim 5, wherein said locking means prevents movement of said restraining means into said active position when said blade is not engaging said mechanism.

7. A blade sharpener according to claim 6, wherein said restraining means coacts with said locking means in response to movement of said blade in said inward direction while said blade is engaging said mechanism, and said restraining means thereby causes movement of said locking means such as to enable the restraining means to adopt said active position.

8. A blade sharpener according to claim 4, wherein said locking means includes a member having an opening therein, said restraining means includes a projection which is connected to said mechanism for movement therewith, said projection is able to locate within said opening when the locking means is in said unlocking position so as to thereby enable said restraining means to move from said active position to said inactive position, and said projection is unable to enter said opening when the locking means is in said locking position and the restraining means is in said active position.

9. A blade sharpener according to claim 8, wherein said projection engages a surface of said member when said restraining means is in the active position and said locking means is in the locking position, and said mechanism is thereby prevented from moving into said operative position.

10. A blade sharpener according to claim 8, wherein said projection remains in said opening when said mechanism has moved away from said inoperative position and said locking means has moved into said locking position.

11. A blade sharpener according to claim 10, wherein said projection coacts with said member during movement of said mechanism towards said inoperative position while said locking means is in the locking position, said coaction causes the locking means to move out of said locking position, and said projection is thereby able to move to a position at which said restraining means can adopt the active position.

12. A blade sharpener according to claim 11, wherein said locking means is spring influenced to move into said locking position when not forced out of that position by said coaction.

13. A blade sharpener according to claim 1, wherein biasing means is connected to said locking means so as to urge the locking means into said locking position, and part of said restraining means responds to movement of said sharpening mechanism from a rest position toward said inoperative positions so as to coact with the locking means and thereby move it out of the locking position.

14. A blade sharpener according to claim 13, wherein said rest position is a position intermediate said operative and inoperative positions, and said sharpening mechanism adopts said rest position when not engaged by said blade.

15. A blade sharpener according to claim 14, wherein said part of the restraining means cooperates with said locking means so as to resists movement of said sharpening mechanism out of said rest position.

16. A blade sharpener according to claim 1, wherein said mechanism and said support are removably located within a hollow elongate housing, a blade access opening is provided at a front end of said housing to permit movement of said blade into and out of the housing, and said release means includes an actuator positioned at or adjacent a rear end of said housing.

17. A blade sharpener according to claim 16, wherein a blade guide is located within said housing and forms part of a sub-assembly adapted to be removed from or placed in said housing as a single unit.

18. A blade sharpener according to claim 17, wherein said sharpening mechanism and said support each forms part of said sub-assembly.

19. A blade sharpener according to claim 18, wherein said support forms part of or is connected to a base structure of said sub-assembly, and said base structure extends substantially the full length of said housing.

20. A blade sharpener according to claim 17, wherein said blade guide includes a groove within which said blade is slidably received, and said locking means is connected to a base of said groove.

21. A blade sharpener according to claim 17, wherein said sub-assembly includes an end cap arranged to extend across said front end of the housing, said blade access opening is formed through said end cap, and said access opening is aligned with said blade guide.

22. A blade sharpener according to claim 21, wherein said support is connected to said end cap and includes two arms extending in laterally spaced relationship in a rearward direction from said end cap, and said mechanism is located between said arms and is mounted on those arms for movement about a pivot axis extending transverse to said arms.

23. A blade sharpener according to claim 19, wherein said actuator is connected to the end of said base structure remote from said housing front end.

24. A blade sharpener according to claim 23, wherein said actuator is pivotally connected to both said base structure and said locking means, and the axis of each said pivotal connection extends transverse to the longitudinal axis of the housing.

25. A blade sharpener according to claim 17, wherein said sub-assembly includes biasing means arranged to engage a back edge of said blade so as to thereby resiliently urge the blade cutting edge into pressure engagement with said sharpening mechanism.

26. A blade sharpener according to claim 17, wherein detent means releasably retains said sub-assembly within said housing, and a release button located at each of two opposite sides of the housing is operable to release the detent means and thereby permit removal of the sub-assembly from the housing.

27. A blade sharpener according to claim 17, wherein the parts of said sub-assembly are connected together and held against separation by means other than separately formed fastening means such as fastening screws.

28. A blade sharpener according to claim 19, wherein said locking means includes stop means which is engageable with said base structure so as to thereby determine said locking position, and said stop means is disengaged from said base structure when said locking means moves towards said unlocking position.

29. A blade sharpener sub-assembly including, a blade sharpener according to claim 1, an elongate base structure, said support forms part of or is connected to said base structure, said sharpening mechanism is located adjacent one end of said base structure, said restraining means is connected to said sharpening mechanism for movement therewith, said locking means includes a member which is movable relative to said base structure in the longitudinal direction thereof, said release means includes an actuator connected to the end of said base structure remote from said one end thereof so as to be movable relative to said base structure, said locking means is connected to said actuator so as to be movable from said locking position toward said unlocking position in response to operation of said actuator, and biasing means acting between said base structure and said locking means so as to urge said locking means into said locking position.

30. A blade scabbard including an open ended hollow elongate housing, and a sub-assembly according to claim 29, wherein said sub-assembly is movable into and out of said housing as a single unit, detent means releasably retains said sub-assembly within said housing at a position such that said actuator is accessible for operation at one end of said housing, and said blade can be moved through the other end of the housing for engagement with, or disengagement from, the sharpening mechanism.

* * * * *